United States Patent [19]

Hire

[11] Patent Number: 4,551,702

[45] Date of Patent: Nov. 5, 1985

[54] THERMOSTATIC SWITCH AND METHOD OF MANUFACTURE

[75] Inventor: Charles J. Hire, Mansfield, Ohio

[73] Assignee: Hi-Stat Manufacturing Company, Inc., Lexington, Ohio

[21] Appl. No.: 573,847

[22] Filed: Mar. 28, 1984

Related U.S. Application Data

[63] Continuation of Ser. No. 257,705, Apr. 27, 1981, abandoned.

[51] Int. Cl.[4] ..... H01H 37/12

[52] U.S. Cl. ..... 337/347; 337/360; 337/368

[58] Field of Search ..... 337/57, 67, 81, 84, 337/94, 112, 347, 349, 360, 368

[56] References Cited

U.S. PATENT DOCUMENTS 3,451,028 6/1969 Schmitt ..... 337/343
3,636,622 1/1972 Schmitt ..... 337/112 X

*Primary Examiner*—George Harris
*Attorney, Agent, or Firm*—Lon H. Romanski

[57] ABSTRACT

A condition responsive switching device has a cup-shaped case, a body secured in abutting assembled relationship to the case, the body and case defining a chamber, a switch mounted on the body in the chamber providing a fixed electrical contact and a cantilever mounted leaf spring, the free end of the leaf spring overlying the fixed contact and providing a mobile contact movable into and out of engagement with the fixed contact, a snap disc in the chamber on the side of the leaf spring remote from the body, the snap disc being movable between two positions of stability in response to two different predetermined environmental conditions, the central portion of the snap disc moving from each position of stability to the other position of stability first with a predetermined amount of creep movement followed by snap movement, the disc and spring arm being operably connected so that the switch is closed when the disc is in one position of stability and is open when the disc is in the other position of stability, the case having an end wall portion thereof selectively plastically deformed generally inwardly as to cause said leaf spring to be deflected by the disc beyond the initial closed position of the switch when the disc is in the one position of stability.

37 Claims, 8 Drawing Figures

THERMOSTATIC SWITCH AND METHOD OF MANUFACTURE

This is a continuation of application Ser. No. 257,705, filed Apr. 27, 1981 abandoned.

FIELD OF THE INVENTION

This invention relates generally to the field of electrical switch assemblies and more particularly to such switch assemblies which are at least in part responsive, in their action, to temperature.

BACKGROUND OF THE INVENTION AND PRIOR ART STATEMENT

Heretofore, various types of thermostats, or the like, employed a snap disc to, in turn, actuate a related switch. Such a snap disc operates to insure that the switch opens and closes with a snap action rather than with a slow creep-type movement. In some devices of this type the disc is formed of bimetal and snaps between two positions of stability in direct response to predetermined changes in monitored temperature.

Snap discs, particularly in the relatively smaller disc sizes, provide a relatively small snap travel. Consequently, heretofore, relatively high precision is required in order to manufacture the prior art thermostats, employing such snap discs, to insure that the manufacturing tolerances of the various components do not result in a device which fails to operate properly.

For example, many snap disc operated prior art thermostats include a bumper or force transmitting member extending between the switch and snap disc. In the manufacture of such prior art thermostats it is common and accepted practice to partially assemble the thermostatic devices and then gauge the subassemblies to determine the exact length of the bumper or force transmitting member required for that particular subassembly. A bumper is then hand fitted to the required length and the assembly completed. Such a manufacturing procedure is expensive since it requires highly skilled assembly personnel, equipment and in some instances still results in defective assemblies.

The prior art has also proposed a thermostatic device which eliminates the need for such selective fitting of the elements. Such are disclosed, for example, in U.S. Pat. Nos. 3,451,028 and 3,636,622 as being, generally, comprised of a cup-shaped case and a switch carrying body which tightly fits into the case with sufficient friction to temporarily retain the body and case in an assembled position. The body and case are free of surfaces which would limit the exact position of the body with respect to the case. During assembly, as disclosed in said U.S. Pat. Nos. 3,451,028 and 3,636,622, the switch carrying body is moved into the case until it is positioned for proper operation with the particular components of the assembled device. Therefore, variations in the size of each element resulting from manufacturing tolerances are automatically compensated for and it is not necessary to selectively fit the various elements of the device. After the switch carrying body is properly positioned in the case, cement is used to hopefully permanently lock or seal the body to the case.

Such prior art thermostatic devices as represented by the disclosures of said U.S. Pat. Nos. 3,451,028 and 3,636,622 have not been found totally acceptable. For example, it has been found difficult to maintain the required respective sizes of the switch carrying body and of the case so as to result in the required degree of interference fit therebetween. This is further aggravated by the fact that the switch carrying body is usually of electrically non-conductive plastic material, or the like, having a first coefficient of thermal expansion and the case, more often than not, is made of metal having a second coefficient of thermal expansion. When such elements are manufactured and then stored, as in normal inventory, the subsequent day-to-day temperature variations result in the switch carrying bodies and the cases experiencing different rates of thermal expansion or contraction which, in turn, often results in either a loss of the required frictional force, as between the cooperating switch carrying body and case, or such a dramatic increase in the magnitude of the actual frictional force as to render it practically impossible to successfully assemble the respective bodies and cases. Further, it has been found that during actual use of such prior art thermostatic devices, the cement, intended to hold the body and case together, will at times fail and such, in turn, leads to ultimate failure of the thermostatic device.

The invention as herein disclosed and described is primarily directed to the solution of the foregoing and related and attendant problems.

SUMMARY OF THE INVENTION

According to the invention, a condition responsive switching device comprises a cup-shaped case providing an axially extending inner wall, a body secured in assembled relationship to said case, said body and said case when in said assembled relationship cooperating to define a chamber, a switch mounted on said body in said chamber providing a fixed electrical contact and a cantilever mounted leaf spring mounted at one end on said body, the free end of said spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined enrivonmental conditions, the central portion of said snap disc moving from each position of stability to the other position of stability first with a predetermined amount of creep movement followed by snap movement, said disc and spring arm being operably connected so that said switch is closed when said disc is in one position of stability and is open when said disc is in the other position of stability, said case comprising axial end wall means, said axial end wall means being selectively deformed axially inwardly toward said chamber so as to thereby result in said spring being deflected by said disc beyond the initial closed position of said switch when said disc is in said one position of stability.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
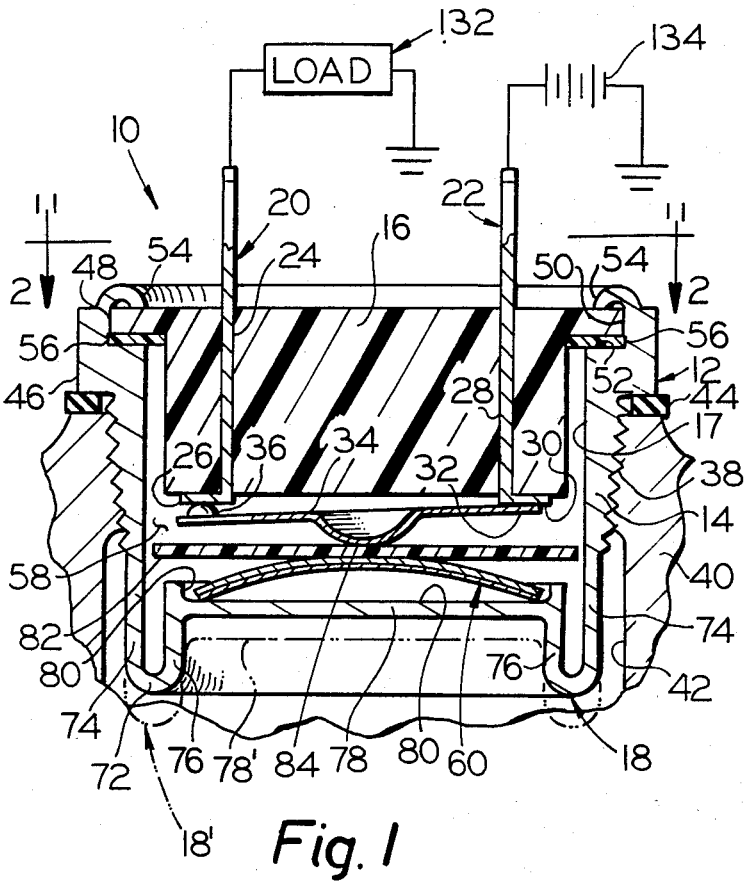
FIG. 1 is a generally axial cross-sectional view of a switching apparatus embodying teachings of the invention.
Figure 2:
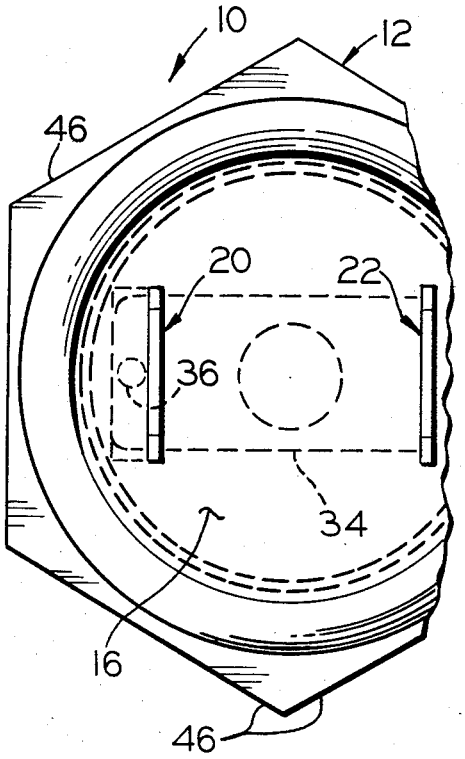
FIG. 2 is a fragmentary view taken generally on the plane of line 2—2 of FIG. 1 and looking in the direction of the arrows.

Referring now in greater detail to the drawings, FIGS. 1 and 2 illustrate a thermostatic electrical switch assembly 10 as comprising housing means 12 which, in turn, comprises a generally lower (as shown in FIG. 1) casing or body 14 and a relatively upper housing or body portion 16. In the embodiment of FIG. 1, the lower housing section or portion 14 is illustrated as comprising a generally tubular or cylindrical body having a generally axially extending inner wall surface 17 which, effectively at the lower end thereof, terminates in an axial end wall portion 18.

The upper housing section or portion 16 is preferably of a dielectric and carries terminal means 20 and 22. Terminal means 20 comprises a shank-like portion 24 which, preferably, continues in its extension beyond housing section 16 and is operatively connected to or integrally formed with a contact portion 26. As generally depicted, the contact portion 26 may abut against a portion of housing section 16. Similarly, terminal means 22 comprises a shank-like portion 28 which, preferably, continues in its extension beyond housing section 16 and is operatively connected to or integrally formed with a portion 30 which may abut against a portion of housing section 16 and which has secured thereto, as by, for example, soldering, one end 32 of a movable electrically conductive arm 34 carrying an electrical contact 36 at its other swingable end.

Preferably, housing section 14 is externally threaded as at 38 so as to enable the switch assembly 10 to be threadably engaged with related structure 40 of which the temperature may be monitored by the assembly 10 or which may contain passage or chamber means 42 and wherein fluid within such chamber or passage means 42 is being monitored. To assist in affecting such threadable engagement, the housing section 14 is preferably provided with appropriate tool-engaging surface means such as depicted, for example, at 46 of FIG. 2. An annular seal may be provided generally between the housing section 14 and structure 40 as at 44.

Housing section 16 also serves as a cover means; that is, in the preferred embodiment, the housing or body portion 16 is provided with a circular-like flange portion 48 which is received as within a counterbore portion 50 formed in housing section 14. After such flange 48 is seated as against the annular shoulder 52 of counterbore 50, the upper open end 54 of lower housing section 14 may be, for example, rolled-over and against the annular flange 48 of upper housing 16 to thereby retain the elements in assembled relationship.

In the preferred embodiment of the structure of FIG. 1, annular sealing gasket means 56 is preferably provided as between flange 48 and counterbore shoulder 52; however, it is contemplated that such gasket means may be eliminated or, for example, instead situated as between the rolled-over annular portion 54 and the flange 48.

The contact arm 34 is internally resiliently biased so that, for example, in the absence of an external force to the contrary, the arm 34 is normally deflected downwardly (as viewed in FIG. 1) so that contact 36 is moved away from contact 26 and the circuit as between terminal means 20 and 22 is opened.

Switch cavity or chamber 58, defined generally by upper housing section 16, inner wall surface 17 and axial end wall 18, in addition to switch arm 34 and contacts 36, 26, also contain a thermostatic bimetallic snap disc 60 which, upon sensing a preselected temperature snaps to a position as generally depicted in FIG. 1 and in so doing operatively engages and urges the contact arm 34 to the position depicted in FIG. 1 closing the circuit as through contact means 26 and 36. As is generally well known, a snap disc, as at 60, operates with snap action to rapidly move between two positions of stability. However, the snap disc does not move with a snap action the entire distance between the two positions of stability. Rather, it creeps or moves slowly through a creep zone until it reaches an unstable condition after which it snaps through the opposite position of stability. This action occurs in both directions.

Figure 3:
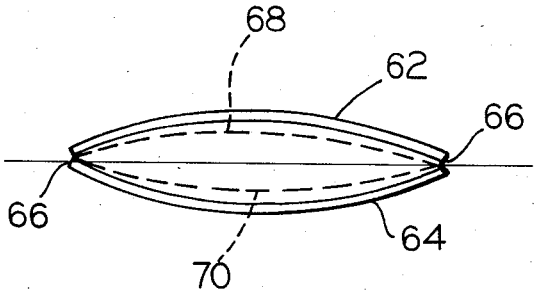
FIG. 3 is a schematic cross-sectional view of a thermostatic snap disc in its two positions of stability.

FIG. 3 depicts a bimetallic snap disc in its two positions of stability as shown in solid line at 62 and 64. In the first condition of stability 62, the snap disc is arched upwardly from its periphery or rim 66. In the second position of stability 64, the central portion within the rim 66 is arched in a downward direction. It is assumed that the first position of stability 62 is the position reached on increasing temperature and the second position of stability 64 is the condition reached on a decrease in temperature. As the disc temperature decreases from its upper snap temperature, the snap disc will move through a creep zone from the position at 62 toward the position at 64 until it reaches an unstable position represented by the dash-line 68. This movement will occur slowly as temperature changes and the unstable position represented by the dash-line 68 will be reached when the disc reaches its lower snap temperature. The movement beyond the position represented by the line 68 to the second position of stability 64 will thereafter occur almost instantaneously as a snap action.

Conversely when the temperature of the disc again increases from the lower snap temperature the disc will move through a creep zone from the second position of stability 64 toward the first position of stability 62 until it reaches an unstable position represented by the dash-line 70. This movement will again be a slow creep movement. When the disc reaches the unstable position 70, it is at a temperature equal to the upper snap temperature and further movement between the position of the dash-line 70 to the first position of stability 62 will again be substantially instantaneous or a snap movement.

The snap movement in one direction, therefore, occurs between the line 68 and the second position of stability 64; and in the other direction between line 70 and the first position of stability 62. The only movement which occurs with snap action in both directions is the movement within the lines 68 and 70. Therefore, it is necessary to arrange a thermostat or the like so that the switch opens and closes within the range of movement represented between the lines 68 and 70. However, if the switch (contacts 26, 36) operated to open and close in the range between lines 62, 68, the switch would snap closed but would creep open. This could cause undesirable arcing and rapid contact deterioration. A similar undesirable condition can occur if the switch (contacts 26, 36) operates in the range between lines 70 and 64.

In the preferred embodiment of the invention, the elements are selected as to have the switch (contacts 26, 36) open and close within the zone of snap, in both directions of operation. The manner in which the switch of the invention is calibrated will be discussed, subsequently.

Referring to FIG. 1, the end wall means 18 is illustrated as comprising a bight-like portion 72 effectively joining the generally tubular wall portions 74 and 76 wherein wall portion 76 is situated generally radially inwardly of the wall portion 74. A generally transversely extending end wall portion 78, preferably, defines at its inner surface a recess or pocket-like portion 80 which loosely contains the temperature responsive snap disc 60. In the embodiment of FIG. 1, a dielectric member 82, which may be of disc-like configuration, is situated generally between the contact arm 34 and snap disc 60 thereby preventing the flow of current as through snap disc 60, wall portions 76, 74 and structure 40 to ground. The snap disc 60, in closing contact 36 against contact 26, does so by moving against portion 84 of contact arm 34 through insulator 82.

Figure 4:
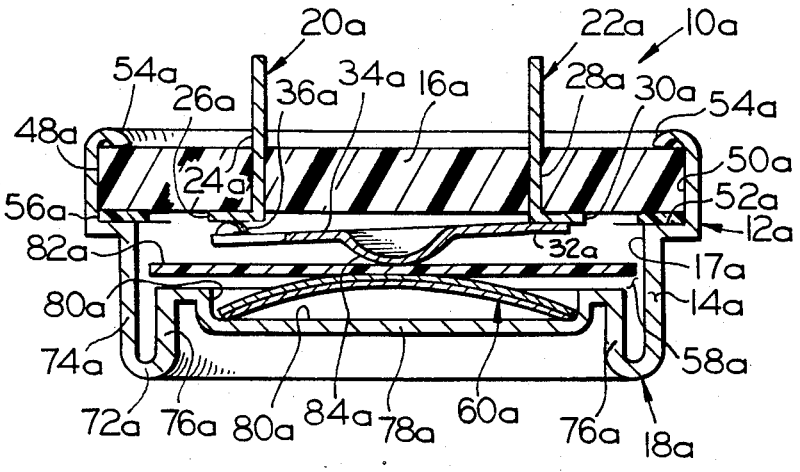
FIG. 4 is a generally axial cross-sectional view of a second switching apparatus also embodying teachings of the invention.

In FIG. 4, all elements which are like or similar to those of the embodiment of FIGS. 1 and 2 are identified with like reference numerals provided with a suffix "a". In comparing the embodiments of FIGS. 1 and 4, it can be seen that the main differences reside in the axial length of upper body or housing sections 16 and **16*a* (the embodiment of 16*a* being relatively shorter) and the elimination, in the embodiment of FIG. 4, of the threaded portion 38 of the housing section 14 of FIG. 1**.

Figure 5:
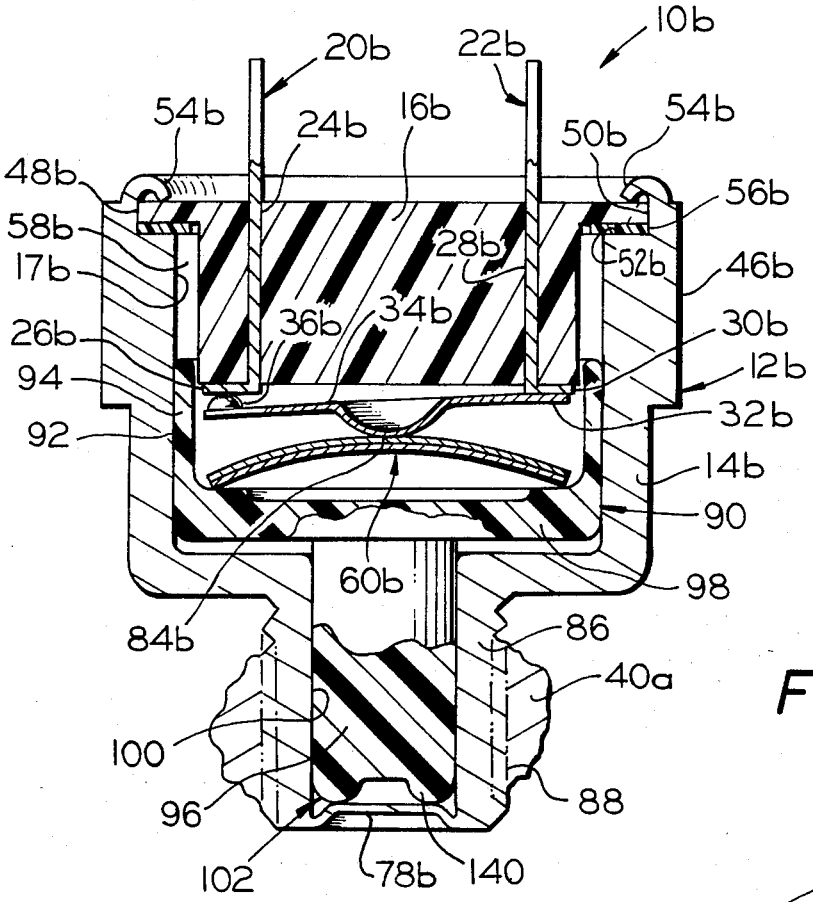
FIG. 5 is a generally axial cross-sectional view of a third switching apparatus also embodying teachings of the invention.

FIG. 5 illustrates another embodiment of the invention. All elements in FIG. 5 which are like or similar to those of either or both FIGS. 1 and 4 are identified with like reference numerals provided with a suffix "b". In the embodiment of FIG. 5, the lower housing portion **14*b* is provided as with a necked-down centrally disposed extension 86 which may be externally threaded as at 88 to cooperate with related structure 40*a***.

In comparing the embodiments of either FIGS. 1 and 5 or FIGS. 4 and 5, it can be seen that while in FIGS. 1 and 4 a dielectric means is situated generally between the contact arm 34 (or **34*a*) and the snap disc 60 (or 60*a*), in the embodiment of FIG. 5, a dielectric means 90 is situated generally between the snap disc 60*b* and housing section 14*b*. The dielectric means 90 is depicted as comprising a cup-like portion 92 having a side wall 94 at least a portion of which effectively comes between the contacts 26*b*, 36*b* and the otherwise juxtaposed portion of inner surface 17*b* of housing section 14*b*. An extension 96, which may be integrally formed with the end wall 98 of cup-like portion 92, is received within passage 100 of housing extension 86 as to have its axial end 102 in abutting engagement with axial end wall 78*b* of extension 86**.

Figure 6:
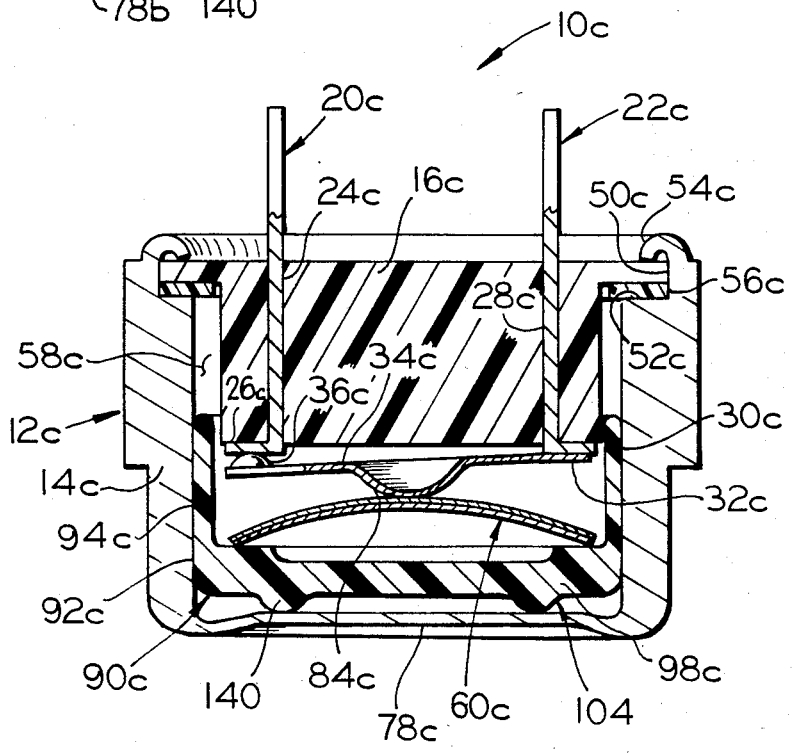
FIG. 6 is a generally axial cross-sectional view of a fourth switching apparatus also embodying teachings of the invention.

FIG. 6 illustrates another embodiment of the invention. All elements in FIG. 6 which are like or similar to any of those of FIGS. 1, 4 or 5 are identified with like reference numerals provided with a suffix "c". In comparing the embodiments of FIGS. 5 and 6, it can be seen that the main difference therebetween is that the insulating means **90*c* of FIG. 6 is devoid of the central extension 96 of FIG. 5 and that the end surface means 104 of the end wall 98*c* is in abutting engagement with axial end wall 78*c* of housing section 14*c***.

Figure 7:
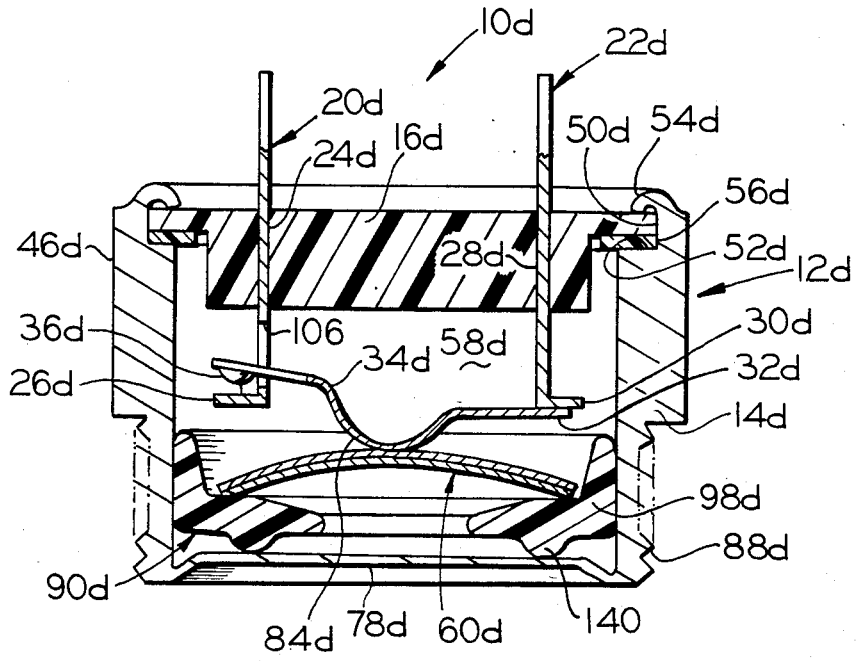
FIG. 7 is a generally axial cross-sectional view of a fifth switching apparatus also embodying teachings of the invention.

In the embodiment of FIG. 7, all elements which are like or similar to those of FIGS. 1, 4, 5 or 6 are identified with like reference numerals provided with a suffix "d". The main difference between the structures of FIGS. 6 and 7 is that the embodiment of FIG. 6 is a normally open switch arrangement whereas the embodiment of FIG. 7 is a normally closed switch (contacts **26*d*, 36*d*) arrangement whereby the snap disc 60*d* functions to open the contacts 26*d* and 36*d* upon attainment of a preselected temperature. As generally depicted, shank portion 24*d* of terminal means 20*d* may be provided with a slot-like aperture 106 permitting the free movement therewithin of the generally swingable end of contact arm 34*d***.

Figure 8:
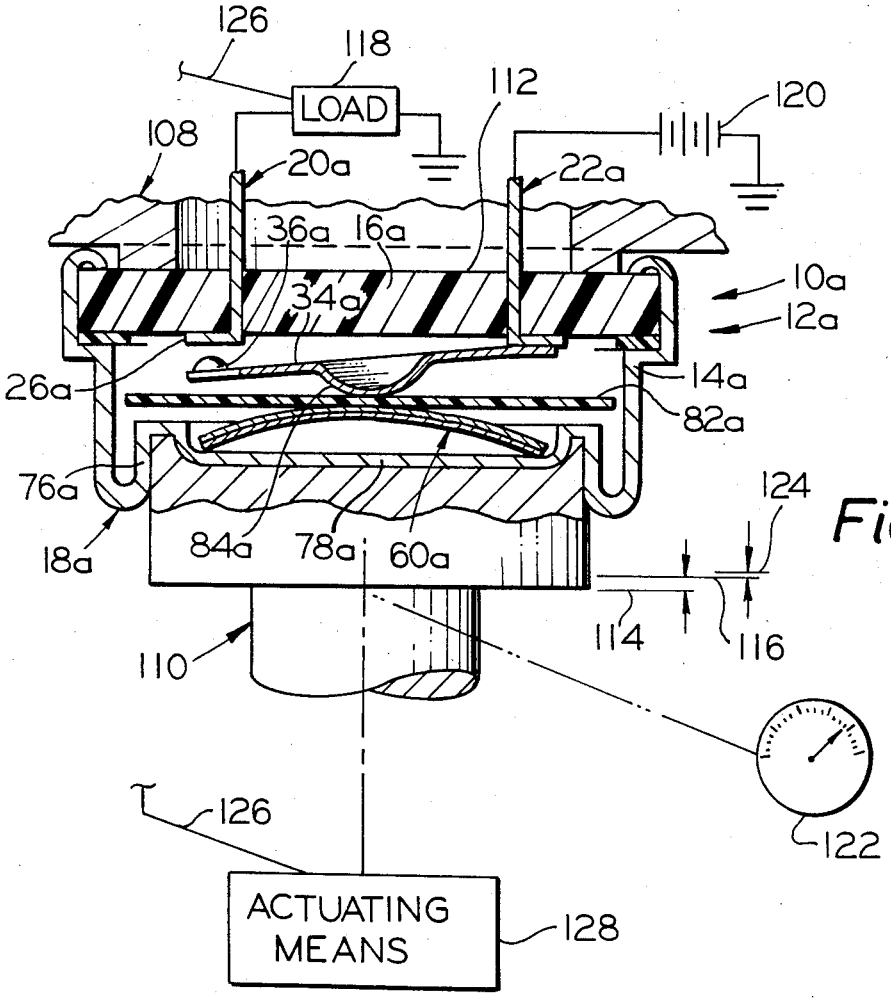
FIG. 8 is a generally axial cross-sectional view of a sixth switching apparatus also embodying teachings of the invention.

In FIG. 8, apparatus as shown in FIG. 4 is employed to, along with other related structure, illustrate a manner by which switch assemblies of the invention may be calibrated or gaged.

Let it be assumed that the various elements comprising switch assembly **10*a* have been assembled and are in the respective relative positions depicted in FIG. 8. This further assumes that snap disc 60*a* has been brought to its desired temperature at which closure of contacts 26*a* and 36*a* is to be affected. Therefore, the snap disc 60*a* may be considered as being in its first position of stability (functionally equivalent to that at 62 of FIG. 3**).

The switch assembly **10*a* is placed as into or against any suitable relatively fixed fixture means, as fragmentarily shown at 108, and related deforming means as, for example, a shaft-like plunger die-like member or the like 110 is employed for achieving the desired calibration. That is, with the abutment type fixture means 108 being operatively engaged as with the outer surface 112 of housing section 16*a*, the tool means 110 is moved into initial engagement with axial end wall means 18*a* and, for purposes of description, let it be assumed that when such initial engagement occurs, some reference point on the tool means 110 is at a position depicted as by line 114**.

After such initial engagement, the tool means 110 is moved upwardly (as viewed in FIG. 8) and such upward movement causes wall portion **76*a* to be drawn generally axially upwardly resulting in snap disc 60*a* being moved upwardly. Such upward movement of tool means 110 causes a continuously corresponding permanent plastic deformation of the end wall means 18*a* and such upward movement continues until contact arm 34*a* has been thereby sufficiently deflected as to cause movable contact means 36*a* to engage fixed contact means 26*a* and close the circuit therethrough. For purposes of illustration, let it be assumed that such closure of contact means 26*a* and 36*a* occurs when the said reference point on the tool means 110 has moved a distance from line 114 to line 116**.

Suitable auxiliary means such as load means 118 and a source of electrical potential 120 are preferably employed as to indicate when such initial closure of contact means 26*a* and 36*a*, by the upward movement of tool means 110, occurs. Such load means 118 may comprise auditory signal generating means and/or visual signal generating means. In the preferred embodiment, after the contact means 26*a* and 36*a* are initially closed (by the described upward movement of tool means 110 and end wall means 18*a*) the upward movement of the tool means 110 is continued so as to further deflect the contact arm 34*a*. During this continued upward movement, the permanent plastic deformation of the end wall means 18*a* continues. The amount of continued or additional upward movement is preferably determined from the temperature (which is known) of the particular snap disc 60*a* being assembled and the amount of creep which such snap disc 60*a* will have for that snap disc temperature and for the temperature of the environment in which the assembly is being performed. If it were determined, for example, that in view of such factors it was necessary, for the then conditions, to deflect the contact arm 34*a* an additional 0.011 inch, suitable gauge means 122 may be employed, as in combination with tool means 110, in order to determine when such 0.011 inch additional deflection has been provided thereby assuring the operation of the snap disc 60*a* (in the opening and closing of the contact means 26*a* and 36*a*) to be within its snap action movement range. During such time the said reference point on said tool means 110 may have moved from the position of line 116 to the position generally depicted by line 124.

It should be apparent that load means 118 also may comprise control means effective for controlling the further or additional upward movement of tool means 110 (and end wall means 18*a*) after initial closure of contact means 26*a* and 36*a*. That is, for example, the load means 118 may be operatively interconnected, as via means 126, with the actuating means 128 (which may move tool means 110) so that upon sensing the initial closure of contact means 26*a* and 36*a*, the actuating means 128 is permitted to further move the tool means 110 (and ultimately contact arm 34*a*) only the predetermined additional distance as diagrammatically depicted by and between lines 116 and 124. When the switch assembly 10*a* of FIG. 8 is finally calibrated, it may be regarded as then assuming a condition as that generally depicted in FIG. 4.

Referring to FIG. 4, as the temperature, sensed by snap disc 60*a*, starts to decrease, the snap disc 60*a* will start to undergo creep movement (as, for example, functionally equivalent from condition 62 to condition 68 of FIG. 3) until, if the sensed temperature decreases sufficiently, the condition of instability is attained (equivalent to condition 68 of FIG. 3). During this creep movement, the contact means 26*a* and 36*a* remain closed because, originally, the contact arm 34*a* was deflected an additional amount, beyond initial closure of contact means 26*a* and 36*a*, at least equal to the creep movement of the snap disc 60*a*. Upon reaching the condition of instability and upon any further decrease in sensed temperature, the snap disc 60*a* will undergo snap action movement to its second position of stability as, for example, functionally equivalent to condition 64 of FIG. 3, thereby permitting the resilient contact arm 34*a* to open contacts 26*a* and 36*a* and the related circuit.

The method of assembly and calibration, as generally described with reference to FIGS. 8 and 4, of course, applies equally well to the embodiments of FIGS. 1, 5, 6 and 7. In each of such, the respective switch assemblies 10, 10*b*, 10*c* and 10*d* are illustrated in their already calibrated condition and as in, for example, the first position of stability. In the structure of FIG. 1, for example, the axial end wall means 18 and wall portion 78 may have assumed a position (or positions) as generally depicted in phantom line at 78' and 18' prior to the actual calibrating procedure. Of course, suitable tool means, functionally equivalent to the tool means 110 of FIG. 8, could be employed for operatively engaging and controllably permanently plastically deforming the axial end wall means 18 (from its 18' position) to achieve the desired calibration.

The same, of course, applies to the structures of FIGS. 5, 6 and 7 wherein the respective axial end wall means 78*b*, 78*c* and 78*d* were controllably permanently plastically deformed, by related suitable tool means (functionally equivalent to tool means 110), to the respective positions depicted in order to obtain the respective desired calibrations.

In the embodiment of FIG. 7 the switching function is opposite to that of the embodiments of FIGS. 1, 4, 5 and 6. That is, when the snap disc 60*d* moves to its first position of stability, its function is to open contact means 26*d* and 36*d* instead of closing such as is done in the embodiments of FIGS. 1, 4, 5 and 6. However, the method of calibration of the assembly of FIG. 7 may be as that already described as with regard to, for example, FIG. 8. That is , suitable tool means (functionally equivalent to tool means 110) would controllably permanently plastically deform the axial end wall means generally axially inwardly toward the chamber 58*d* with such movement continuing until the then closed contact means 26*d* and 36*d* become opened. (This would be as if having attained a position or condition equivalent or corresponding to line 116 of FIG. 8). The tool means would be moved further toward the chamber 58*d* a distance, preferably, at least equal to the creep movement (equivalent to the difference in depicted positions or conditions 62, 68 of FIG. 3) of the snap disc 60*d* thereby assuring that the snap disc will operate within its range of snap movement.

In the practice of the invention, in the preferred embodiment thereof, the upper housing or casing section 16 is of electrically non-conductive material thereby permitting the terminal means 20 and 22, respectively leading as to related load means 132 and source of electrical potential 134, to be carried thereby. In those situations where annular sealing means as at 56 is to be employed, it should be apparent that such sealing means may be situated as between, for example, the rolled over portion 54 and juxtaposed portion of flange 48 thereby providing for a direct seating of the flange 48 against the shoulder seating surface 52.

The invention also provides further benefits. For example, as shown in FIGS. 1 and 4, the housing or casing means 14 is formed of metal which can be electrically conductive. In order to prevent the completion of an undesired circuit as through contact arm 34, snap disc 60 and housing portion 14 (to related holding or supporting housing means 14) the provision of suitable electrical insulating means becomes necessary. A benefit which becomes available by the practice of the invention is the employment of what is, in effect, a loose or free insulating member 82 placed as to be between the contact arm 34 and the snap disc 60. Not only does the member 82 serve to insulate the thermostatic means 60 from contact lever 34, it, by virtue of its position or relative location, enables the thermostatic means 60 to be in intimate contact with the wall means 18, 78 thereby making such means 60 most responsive to changes in the temperature to which the assembly 10 is exposed.

The embodiments of FIGS. 5, 6 and 7 illustrate insulating means 90 situated within the switch chamber or cavity 58*b*. The insulating means 90 may be of the type where the insulating properties are with respect to electricity but which may be either a good or poor conductor of heat. In each of the embodiments of the insulating means 90, 90*c* and 90*d* the ends thereof are depicted as comprising a generally annular portion 140 which abuts against the permanently deflected wall portions 78*b*, 78*c* and 78*d* of the housings or casings. It should be made clear that the provision of such annular portion 140 is not necessary to the practice of the invention and that such axial end surfaces of the insulating means 90, 90*c* and 90*d* may, for example, be flat and normal to the axis of the said insulating means.

In the embodiments of FIGS. 5 and 6, a further benefit is illustrated. That is, with reference to, for example, FIG. 5, it can be seen that the annular side wall portion 92 of the insulating or carrier means 90 is of an axial length so that it effectively comes between the cooperating electrical contacts 26*b* and 36*b* on one side thereof and the assumed electrically conductive wall of the housing or casing means 14*b*. As a consequence, the arrangement provides additional protection against the accidental electrical "shorting" as from either or both contacts 26*b*, 36*b* to the juxtaposed wall of casing 14*b*. As is apparent, the wall 94*c* of insulating means 90*c* of FIG. 6 is similarly axially extended to also provide against such electrical "shorting".

Although only a preferred embodiment and a select number of alternate embodiments and modifications of the invention have been disclosed and described, it is apparent that other embodiments and modifications of the invention are possible within the scope of the appended claims.

What is claimed is:

1. A condition responsive switching device comprising a cup-shaped case having an open end and providing an axially extending inner wall, a body secured in axially abutting assembled relationship to said case as to close said open end, said body and said case when in said assembled relationship cooperating to define a chamber, a switch mounted on said body in said chamber providing a fixed electrical contact and a cantilever mounted leaf spring mounted at one end on said body, the axial location of said switch relative to said axially extending inner wall being determined by said axially abutting assembled relationship of said body to said cup-shaped case, the free end of said leaf spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined environmental conditions, the central portion of said snap disc moving from each position of stability to the other position of stability first with a predetermined amount of creep movement followed by snap movement, said disc and leaf spring being operably connected so that said switch is closed when said disc is in one position of stability and is open when said disc is in the other position of stability, said case comprising axial end wall means oppositely disposed to said open end, said axial end wall means being selectively deformed axially inwardly toward said chamber so as to thereby result in said leaf spring being deflected toward said body which is secured in an axially abutting relationship to said cup-shaped case by said disc beyond the initial closed position of said switch when said disc is in said one position of stability.

2. A condition responsive switching device according to claim 1 and further comprising electrical insulating means for preventing the occurrence of an electrical path from said switch through said snap disc and into said case.

3. A condition responsive switching device according to claim 1 and further comprising insulating means for insulating said snap disc from said leaf spring.

4. A condition responsive switching device according to claim 2 wherein said insulating means comprises an insulating member situated generally in said chamber and between said snap disc and said leaf spring as to be at times in operative engagement with both said snap disc and said leaf spring.

5. A condition responsive switching device comprising a cup-shaped case providing an axially extending inner wall, a body secured in assembled relationship, to said case, said body and said case when in said assembled relationship cooperating to define a chamber, a switch mounted on said body in said chamber providing a fixed electrical contact and a cantilever mounted leaf spring mounted at one end on said body, the free end of said leaf spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined environmental conditions, the central portion of said snap disc moving from each position of stability to the other position of stability first with a predetermined amount of creep movement followed by snap movement, said disc and leaf spring being operably connected so that said switch is closed when said disc is in one position of stability and is open when said disc is in the other position of stability, said case comprising axial end wall means, said axial end wall means being selectively deformed axially inwardly toward said chamber so as to thereby result in said leaf spring being deflected by said disc beyond the initial closed position of said switch when said disc is in said one position of stability, and electrical insulating means for preventing the occurrence of an electrical path from said switch through said snap disc and into said case, said insulating means comprising an insulating member situated generally in said chamber and between said snap disc and said leaf spring as to be at times in operative engagement with both said snap disc and said leaf spring, said insulating member having a projected axial area substantially larger than the projected axial area of said snap disc.

6. A condition responsive switching device comprising a cup-shaped case providing an axially extending inner wall, a body secured in assembled relationship to said case, said body and said case when in said assembled relationship cooperating to define a chamber, a switch mounted on said body in said chamber providing a fixed electrical contact and a cantilever mounted leaf spring mounted at one end on said body, the free end of said leaf spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined environmental conditions, the central portion of said snap disc moving from each position of stability to the other position of stability first with a predetermined amount of creep movement followed by snap movement, said disc and leaf spring being operable connected so that said switch is closed when said disc is in one position of stability and is open when said disc is in the other position of stability, said case comprising axial end wall means, said axial end wall means being selectively deformed axially inwardly toward said chamber so as to thereby result in said leaf spring being deflected by said disc beyond the initial closed position of said switch when said disc is in said one position of stability, electrical insulating means for preventing the occurrence of an electrical path from said switch through said snap disc and into said case, said electrical insulating means comprising cup-like carrier means situated generally within said chamber, and said carrier means comprising axial cup-end wall means and axially extending side wall means, said side wall means being in operative engagement with said inner wall, and said snap disc being carried by said carrier means.

7. A condition responsive switching device according to claim 6 wherein said axially extending side wall means extends generally between said switch and said inner wall.

8. A condition responsive switching device according to claim 6 wherein said axially extending side wall means is annular in configuration, and wherein said axially extending side wall means effectively circumscribes said switch as to be radially outwardly of said switch and radially inwardly of said inner wall.

9. A condition responsive switching device according to claim 6 wherein said axial cup-end wall means is operatively in abutting relationship to said axial end wall means of said case.

10. A condition responsive switching device according to claim 7 wherein said axial cup-end wall means is operatively in abutting relationship to said axial end wall means of said case.

11. A condition responsive switching device according to claim 3 wherein said insulating means comprises an insulating member situated generally in said chamber and between said snap disc and said leaf spring as to be at times in operative engagement with both said snap disc and said leaf spring.

12. A condition responsive switching device comprising a cup-shaped case providing an axially extending inner wall, a body secured in assembled relationship to said case, said body and said case when in said assembled relationship cooperating to define a chamber, a switch mounted on said body in said chamber providing a fixed electrical contact and a cantilever mounted leaf spring mounted at one end on said body, the free end of said leaf spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined environmental conditions, the central portion of said snap disc moving from each position of stability to the other position of stability first with a predetermined amount of creep movement followed by snap movement, said disc and leaf spring being operably connected so that said switch is closed when said disc is in one position of stability and is open when said disc is in the other position of stability, said case comprising axial end wall means, said axial end wall means being selectively deformed axially inwardly toward said chamber so as to thereby result in said leaf spring being deflected by said disc beyond the initial closed position of said switch when said disc is in said one position of stability, and insulating means for insulating said snap disc from said leaf spring, said insulating means comprising an insulating member situated generally in said chamber and between said snap disc and said leaf spring as to be at times in operative engagement with both said snap disc and said leaf spring, said insulating member having a projected axial area substantially larger than the projected axial area of said snap disc.

13. A condition responsive switching device according to claim 1 wherein said cup-shaped case comprises an externally threaded portion for threadable engagement with associated structure.

14. A condition responsive switching device according to claim 13 wherein said cup-shaped case comprises a first relatively large case section and second relatively small case section integrally formed with said first case section, and wherein said externally threaded portion is carried by said second relatively small case section.

15. A condition responsive switching device according to claim 1 wherein said body is secured to said case in a manner whereby said body and said case are operatively in axial abutting relationship with each other.

16. A condition responsive switching device according to claim 1 wherein said case comprises abutment surface means, and wherein said body is in operative abuting relationship to said abutment surface means.

17. A condition responsive switching device according to claim 1 wherein said axial end wall means of said case having at least a portion thereof of relatively thin cross-section as to thereby at least tend to localize stress concentration therein and enhance the plastic deformation thereof.

18. A condition responsive switching device according to claim 1 wherein said axial end wall means of said case comprises a generally U-shaped annular bight portion and an end face generally telescoped within said U-shaped annular bight portion.

19. A method of assembling a condition-sensing switching device operated by a snap disc which has two positions of stability and which is subject to creep to adjacent positions of instability comprising the steps of mounting a switch on a body, positioning a concave snap-acting disc in a cup-shaped case with the convex side thereof exposed for switch engagement, securing said body to said case in a manner as to preclude axial movement relative to each other, plastically deforming a portion of said cup-shaped case as to thereby cause said disc to be moved in a direction toward an intermediate position wherein said switch is engaged by said disc and is first operated, determining when said intermediate position is attained by sensing the operation of said switch, sand thereafter continuing the plastic deformation of said portion of said cup-shaped case and thereby continuing to cause said disc to be moved in said direction an additional predetermined distance to a final assembled position, said additional predetermined distance being at least equal to the amount of creep from the closest position of instability existing during assembly.

20. A method of assembling a condition-sensing switching device according to claim 19 wherein said assembly is performed without snapping said disc.

21. A method of assembling a condition-sensing switching device according to claim 19 wherein said disc is a temperature responsive bimetallic disc, and said predetermined distance is adjusted to compensate for the temperature of said disc during assembly.

22. A temperature responsive electrical switch assembly, comprising housing means, said housing means comprising a first housing body portion and a second housing body portion, electrical contact means carried generally within said housing means by said first housing body portion, said electrical contact means being effective to be operated as to open and close related circuit means, mechanical abutment means, temperature responsive means carried generally within said housing means and effective for at least at times operatively engaging said contact means to effect operation thereof, and plastically deformed housing portion means carried by said second housing body portion, said plastically deformed housing portion means being effective to position said temperature responsive means in a selected operating position relative to said contact means, said abutment means being effective to cause said first and second housing body portions to be in operative abutting relationship to each other and abuttingly prevent said first housing body portion and said electrical contact means from moving relative to said second housing body portion in a direction toward said plastically deformed housing portion means.

23. A temperature responsive electrical switch assembly according to claim 22 wherein said second housing body portion is of a generally cup-shaped configuration having a closed axial end wall means, and wherein said axial end wall means comprises said plastically deformed housing portion means.

24. A temperature responsive electrical switch assembly according to claim 22 and further comprising electrical insulating means for preventing the occurrence of an electrical path from said contact means and into said housing means.

25. A temperature responsive electrical switch assembly according to claim 22 and further comprising insulating means for insulating said contact means from said temperature responsive means.

26. A temperature responsive electrical switch assembly, comprising housing means, electrical contact means carried generally within said housing means, said electrical contact means being effective to be operated as to open and close related circuit means, temperature responsive means carried generally within said housing means and effective for at least at times operatively engaging said contact means to affect operation thereof, plastically deformed housing portion means, said plastically deformed housing portion means being effective to position said temperature responsive means in a selected operating position relative to said contact means, and electrical insulating means for preventing the occurrence of an electrical path from said contact means and into said housing means, said insulating means comprising an insulating member situated within said housing means and between said contact means and said temperature responsive means as to thereby at times be in operative simultaneous engagement with said contact means and said temperature responsive means.

27. A temperature responsive electrical switch assembly, comprising housing means, electrical contact means carried generally within said housing means, said electrical contact means being effective to be operated as to open and close related circuit means, temperature responsive means carried generally within said housing means and effective for at least at times operatively engaging said contact means to affect operation thereof, plastically deformed housing portion means, said plastically deformed housing portion means being effective to position said temperature responsive means in a selected operating position relative to said contact means, and electrical insulating means for preventing the occurrence of an electrical path from said contact means and into said housing means, said insulating means comprising an insulating member situated within said housing means and between said contact means and said temperature responsive means as to thereby at times be in operative simultaneous engagement with said contact means and said temperature responsive means, said insulating member having a projected axial area substantially larger than the projected axial area of said temperature responsive means.

28. A temperature responsive electrical switch assembly, comprising housing means, electrical contact means carried generally within said housing means, said electrical contact means being effective to be operated as to open and close related circuit means, temperature responsive means carried generally within said housing means and effective for at least at times operatively engaging said contact means to affect operation thereof, plastically deformed housing portion means, said plastically deformed housing portion means being effective to position said temperature responsive means in a selected operating position relative to said contact means, and comprising electrical insulating means for preventing the occurrence of an electrical path from said contact means and into said housing means, said electrical insulating means comprising cup-like carrier means situated within said housing means, said carrier means comprising axial cup-end wall means and axially extending side wall means, said side wall means being at least in part in operative engagement with said housing means, said temperature responsive means being carried by said carrier means.

29. A temperature responsive electrical switch assembly according to claim 28 wherein said axially extending side wall means extends generally between said contact means and said housing means.

30. A temperature responsive electrical switch assembly according to claim 28 wherein said axially extending side wall means is annular in configuration, and wherein said axially extending side wall means effectively circumscribes said contact means as to be radially outwardly of said contact means and radially inwardly of said housing means.

31. A temperature responsive electrical switch assembly, comprising housing means, electrical contact means carried generally within said housing means, said electrical contact means being effective to be operated as to open and close related circuit means, temperature responsive means carried generally within said housing means and effective for at least at times operatively engaging said contact means to affect operation thereof, plastically deformed housing portion means, said plastically deformed housing portion means being effective to position said temperature responsive means in a selected operating position relative to said contact means, said housing means being of a generally cup-shaped configuration having a closed axial end wall means, and electrical insulating means for preventing the occurrence of an electrical path from said contact means and into said housing means, said electrical insulating means comprising cup-like carrier means situated within said housing means, said carrier means comprising axial cup-end wall means and axially extending side wall means, wherein said side wall means is at least in part in operative engagement with said housing means, wherein said temperature responsive means is carried by said carrier means, and wherein said axial cup-end wall means is operatively in abutting relationship to said axial end wall means of said housing means.

32. A temperature responsive electrical switch assembly according to claim 31 wherein said plastically deformed housing portion means comprises said axial end wall means.

33. A temperature responsive electrical switch assembly according to claim 22 wherein said housing means comprises an externally threaded portion for threadable engagement with associated structure.

34. A temperature responsive electrical switch assembly according to claim 22 wherein at least a portion of said housing means is of reduced cross-sectional thickness as to thereby at least tend to localize stress concentration therein and thereby at least in part define said plastically deformed housing portion means.

35. A temperature responsive electrical switch assembly according to claim 23 wherein said axial end wall means comprises a generally U-shaped annular bight portion and an end face generally telescoped within said U-shaped annular bight portion.

36. A method of assembling a temperature responsive electrical switch assembly according to claim 19 wherein said cup-shaped case comprises a closed axial end wall, and wherein the step of plastically deforming a portion of said cup-shaped case comprises the step of plastically deforming said axial end wall.

37. A condition responsive switching device comprising a cup-shaped case providing an axially extending inner wall, a body secured in assembled relationship to said case, said body and said case when in said assembled relationship cooperating to define a chamber, a switch mounted on said body in said chamber providing a fixed electrical contact and a cantilever mounted leaf spring mounted at one end on said body, the free end of said leaf spring overlying said fixed contact and providing mobile contact means movable into and out of engagement with said fixed contact to close and open said switch, a snap disc in said chamber on the side of said leaf spring remote from said body, said snap disc being movable between two positions of stability in response to two different predetermined environmental conditions, the central portion of said snap disc moving from each position of stability to the other position of stability first with a predetermined amount of creep movement followed by snap movement, said disc and leaf spring being operably connected so that said switch is closed when said disc is in one position of stability and is open when said disc is in the other position of stability, said case comprising axial end wall means, said axial end wall means being selectively deformed axially inwardly toward said chamber so as to thereby result in said leaf spring being deflected by said disc beyond the initial closed position of said switch when said disc is in said one position of stability, said selectively deformed end wall means being the only means for causing said leaf spring to be deflected by said disc beyond the initial closed position of said switch when said disc is in said one position of stability.

* * * * *

UNITED STATES PATENT AND TRADEMARK OFFICE

CERTIFICATE OF CORRECTION

PATENT NO. : 4,551,702

DATED : November 5, 1985

INVENTOR(S) : Charles J. Hire

It is certified that error appears in the above—identified patent and that said Letters Patent is hereby corrected as shown below:

Claim 6, line 20 thereof, change "operable" to --- operably ---.

Claim 19, line 15 thereof, change "sand" to --- and ---.

Signed and Sealed this

*Eighteenth* Day of *February 1986*

[SEAL]

*Attest:*

DONALD J. QUIGG

*Attesting Officer*

*Commissioner of Patents and Trademarks*